United States Patent [19]

Chappell

[11] 4,352,978

[45] Oct. 5, 1982

[54] ANALOG BALANCE

[76] Inventor: James Chappell, P.O. Box 783, Nelson, New Zealand

[21] Appl. No.: 308,781

[22] Filed: Oct. 5, 1981

[51] Int. Cl.[3] ..... G06G 1/02

[52] U.S. Cl. ..... 235/70 R; 235/69

[58] Field of Search ..... 235/69–70 D, 235/61 GM, 61 FE, 61 A, 61 R, 124, 127, 65, 79.5, 84

[56] References Cited

U.S. PATENT DOCUMENTS 1,570,352 1/1926 Isom ..... 235/70 R

OTHER PUBLICATIONS

"Equaliser Balance" by ESA Creative Learning, 7016/824.

*Primary Examiner*—Benjamin R. Fuller

*Attorney, Agent, or Firm*—McAulay, Fields, Fisher, Goldstein & Nissen

[57] ABSTRACT

A calculating device comprising a rockable cradle having a number of parallel grooves formed in its upper surface, each of which supports a beam provided on at least one of its faces with a calculating scale so that the beam has sliding movement within the groove, along its longitudinal axis. A cursor line which lies normal to the longitudinal axis of the sliding beams is marked on the upper face of the rockable cradle. In typical use a slidable beam having a question scale marked on one of its faces is moved so that a question integer on the question scale registers with the cursor line thereby providing a rotating torque about the axis of rotation of the rockable cradle. A further slidable beam having an answer scale marked on one of its faces is moved so as to provide a rotating torque in antiphase direction to that provided by the question scale beam, the antiphase torque being adjusted to such a magnitude that the cradle is balanced and the beams are horizontal. The answer integer may then be read from the answer scale where the same registers with the cursor line.

6 Claims, 4 Drawing Figures

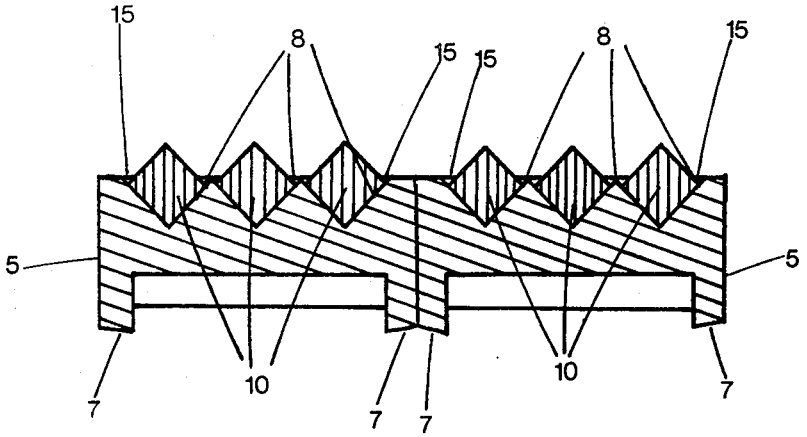
FIG 2
FIG 3
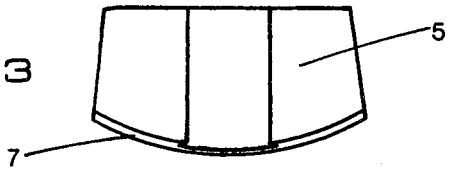
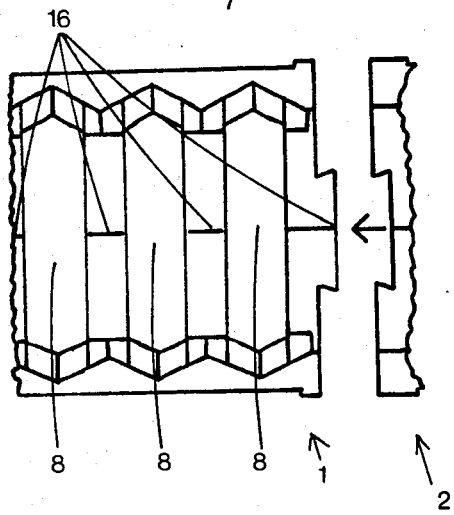
FIG 4

ANALOG BALANCE

This invention relates to a calculating device which may be utilized for calculating and for demonstrating the process of arithmetical calculations.

The concept of the invention is the utilization of unit forces or multiples of unit forces to a lever so that the lever can be held in a balance condition by the sum of the moments applied to it. Scale means are provided so that when the component parts of the lever are in a balance condition, then the values shown on the scale are the component factors of an arithmetical calculation. The invention thus allows the visual display of the relationship between the unit forces and the result obtained by such relationship. The balance arrangement is obtained by means of a cradle which has a fulcrum point or a nominal fulcrum point and the scale is represented on a series of beams each of which can be moved in a direction longitudinal to the axis of the beam, so that the imbalance imparted to the balance arrangement by the off setting of one beam can be counteracted by an appropriate movement of another beam. A cursor or other indicating means is mounted so that the scale is readable at the centre of gravity of the balance arrangement.

It is therefore an object of this invention to provide a device which will fulfil the above requirements and which will visually demonstrate the interaction of the units involved in an arithmetical calculation.

Accordingly the invention may be said to comprise a calculating device comprising a rockable cradle adapted to be rocked about an axis of rotation and to support a plurality of beams, each of which has longitudinal sliding movement within said cradle in a direction parallel to the other said beams, and transverse to the said axis of rotation; the said cradle having a cursor line which extends parallel to the said axis of rotation; wherein at least two of the beams are slidable separately within the cradle to provide a rotating torque about the axis of rotation of the said cradle, said rotating torque being dependent upon the combined out-of-balance weight of the beams in relation to the said cursor line, and wherein at least one further beam is longitudinally slidable within the cradle to a position where it may impart a further rotating torque about the axis of rotation of the said cradle, said further rotating torque being antiphase to the combined rotating torque of the said two of the beams.

In a preferred form of the invention, the device consists of a rocking cradle and a plurality of elongated beams which are preferably of square cross-sectional shape. Each beam can be formed for instance from an injection moulded plastics material and each beam is of a substantially identical weight and length. The beams are arranged to be held in a form of cradle so that the beams can be extended to either side of the cradle which is constructed in a manner that the beams will be securely held within the cradle and yet have a free longitudinal sliding movement therein. One side, herein the underside, of the cradle is radiused so that it can be placed on a plane surface and freely rock on such surface. The cradle has a point of equilibrium, and when in a balanced condition, the upper side of the cradle will be in a horizontal plane.

The upper side of the cradle is provided with a plurality of housings that will individually support the beam in a manner that each beam will lie parallel to the adjacent beam and so that the beams can slide longitudinally through the housing. The beams are so constructed that a specific length of each beam will be equivalent in weight to a specific length of any other beam. Each beam has a scale marked on each of its faces so that if the beam is of square cross sectional shape, it will have four scales. Each scale may be formed by a hot stamping impression or the like so as to ensure a permanent marking on the faces of the beams. One face of each beam is provided with a linear scale which extends each way from the centre of gravity of the beam which point will display a value of 0, with the length of the scale on each side of the centre of gravity being divided into ten main divisions, with subdivisions being provided as required. The said scale is notated at the left hand end with the notation Q− and at the right hand end with the notation Q+. All numerals on the Q− side of the point of centre of gravity will have a minus denomination, and all numerals on the Q+ side of the centre of gravity will have a plus denomination. The second face of each said beam is provided with an identical linear scale to the said first scale but is also provided at its left hand end with the notation A+ and at its right hand the notation A− with the numerals having the appropriate plus or minus denomination.

The third face of each beam is provided with an antilog scale which extends on either side of the centre of gravity which point will display the value of 1 on the scale. The scale extends up to ten units on either side of the centre of gravity with each unit being suitably subdivided as required. The left hand end of the scale is provided with the notation Q÷ and the right hand end of the scale is provided with the notation Q× with the numerals having the plus or minus denomination as previously mentioned with the linear scale. The fourth face is provided with an identical antilog scale to that of the third scale except that its left hand end carries the notation A× and the right hand end carries the notation A÷.

The balance can be used to calculate and demonstrate simple arithmetical equations, and other arithmetical functions.

A preferred embodiment of the calculating device will be described with reference to the accompanying drawings wherein:

FIG. 2 shows a cross-sectional view along line II—II of FIG. 1;

FIG. 3 shows a view of one end of a cradle section;

FIG. 4 shows a plan view of the jointing of two cradle sections;

Figure 1:
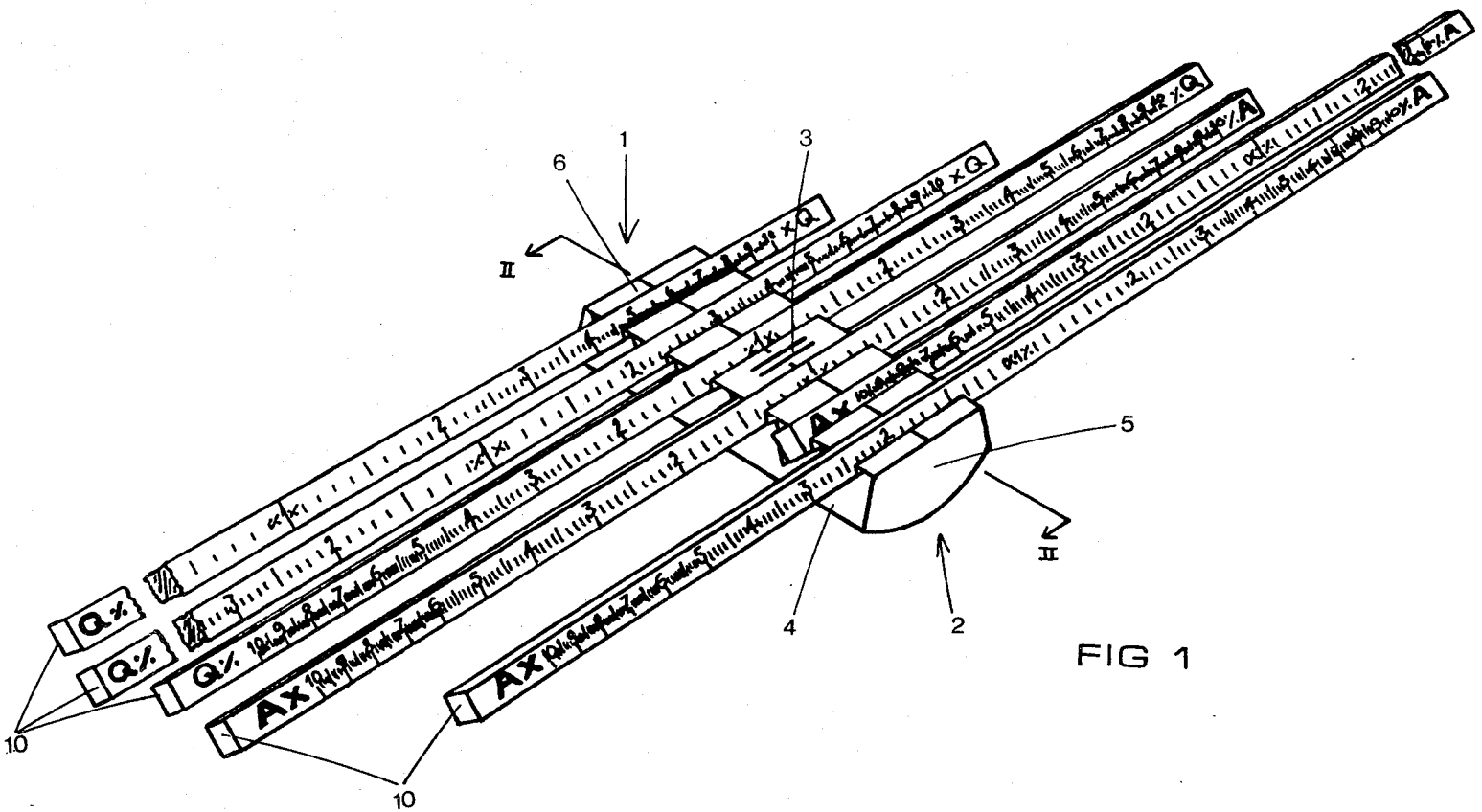
FIG. 1 shows a view of the preferred embodiment of the calculating device comprising two cradles joined, with three beams slidably positioned within each said cradle section.

With reference to the drawings it can be seen that the preferred embodiment of the calculating device shown therein comprises two cradle sections generally indicated at 1 and 2, and joined at 3. Each cradle section is substantially an upturned square box having two side faces indicated at 4, two parallel end faces indicated at 5 and an upper surface indicated at 6. The lower edges of the two parallel end faces 5 project beyond the lower edges of the two side faces and are curved so as to form two parallel rockers 7 which allow the cradle to be rocked when it is placed on a plane surface. The upper surface 6 of each of the cradle sections 1 and 2 is provided with three triangular shaped grooves 8 which extend between the side faces 4 so as to be parallel to the two end faces. The two cradle sections of FIG. 1 are joined by way of a dovetail joint i.e. a flared mortise and tenon joint, the tenon being provided in an end face of cradle section 1, and the co-operating mortise being formed into an end surface of cradle section 2. The said joint is orientated such that the two cradle sections may only be separated by sliding them apart in a vertical plane. Although there are shown in the preferred embodiment, only two cradle sections joined by such a joint, by suitable provision of a mortise in one end face and a tenon in the other end face of each cradle section, as many cradle sections may be joined together as desired. Furthermore, it is envisaged that the calculating device may utilise any other suitable jointing method which allows cradle sections to be readily joined together or pulled apart, or alternatively it is envisaged that a single cradle section having the desired number of said triangular grooves may be provided without requiring the addition of any further cradle sections.

Each of the three triangular grooves 8 formed into the upper surface 6 of each cradle section is provided with an elongated beam 10, slidably positioned within the said triangular groove, the shape of the groove being complementary to the outer surface of the beam 10 such that the beam may be readily pushed or pulled so as to slide longitudinal of its length within its respective triangular groove 8. Each beam 10 may be securely maintained within each triangular groove by way of lips 15 which extend outwardly from the upper edges of each triangular groove, as clearly shown in FIG. 2 and are adapted to maintain each beam within its respective triangular groove, while allowing the beam to slide freely as hereinbefore described. Alternatively there may be provided lugs projecting outwardly from within each triangular groove, said lugs being adapted to engage grooves formed in the outer surface of each respective elongated beam 10.

Marked on the upper surface of the cradle sections 1 and 2 by ink, hot stamping or any suitable process, is a cursor line 16. This cursor line is carefully positioned such that it lies in a plane which exactly bisects cradle section transverse to the longitudinal axis of the triangular grooves.

An essential feature of the calculating device is embodied in the construction of the beams 10. These beams 10 are all of substantially identical weight and length and also of substantially identical and uniform weight per unit length. They may be formed of any suitable material or by any suitable process known in the art. In the preferred embodiment the beams are of a square cross-section and have marked on each of their four outer side faces a calculating scale, these scales being preferably marked with differently coloured ink by hot stamping or other suitable method to provide easy identification of each individual scale.

One face of beam 10 is provided with a linear scale which extends each way from the centre of gravity of the beam which point will display a value of 0, with the length of the scale on each side of the centre of gravity being divided into ten main divisions, with subdivisions being provided as required. The said scale is notated at the left hand end with the notation Q− and at the right hand end with the notation Q+. All numerals on the Q− side of the point of centre of gravity will have a minus denomination, and all numerals on the Q+ side of the centre of gravity will have a plus denomination. The second face of each said beam 10 is provided with an identical linear scale to the said first scale except that it is provided at its left hand end with the notation A+ and at its right hand end, and the notation A− with the numerals having the appropriate plus or minus denomination.

The third face of each beam 10 is provided with an antilog scale which extends on either side of the centre of gravity which point will display the value of 1 on the scale. The scale extends up to ten units on either side of the centre of gravity with each unit being suitably subdivided as required. The left hand end of the scale is provided with the notation Q÷ and the right hand end of the scale is provided with the notation Q× with the numerals having the plus or minus denomination as previously mentioned with the linear scale. The fourth face is provided with an identical antilog scale to that of the third scale except that its left hand end carries the notation A× and the right hand end carries the notation A÷.

The balance can be utilized to calculate and demonstrate simple or complicated equations and the following examples are given as representative only of certain of the actions that can be undertaken with the balance.

In the simplest form utilizing the linear scale, two beams only are placed in the cradle with the integers aligned in the same direction but with one beam having the linear scale displaying the integers A+ and A−, (herein referred to as the answer scale) and a second beam with the linear scale displaying having the integers Q+ and Q− (herein referred to as the question scale). If the two beams are moved longitudinally in relation to each other within the balance, then the whole arrangement can be brought into a position of equilibrium with the longitudinal axis of the beams horizontal. At such a position all contiguous integers at the cursor line will display an addition or subtraction which will give an identical unit value.

A second simple operation by the use of the balance consists in the addition of two units. In such a case two linear question scales and one linear answer scale is utilized. If it is desired for instance to find the answer to the addition of 2 units and 2 units, then the two beams each having a question scale are moved through the balance until the numeral 2 on each scale registers with the cursor line on the cradle. The beam having the answer scale is then moved until the whole cradle is in balance, whereupon the answer to the problem will be shown on the answer scale underneath the cursor, i.e. the answer scale will indicate the unit 4. The utilization of three beams will enable the calculation and demonstration of simple arithmetical additions and subtractions between the units minus 10 to plus 10. If sums having an answer greater than ten are required, then it is necessary to utilize four or more beams so that two beams having the linear question scale will be utilized and two beams having the linear answer scale will be utilized. The two beams having the question scales are moved so that the correct units for the calculation are displayed under the cursor and the beams having the answer scales are then moved until the device is in balance and the answer is then given by the simple addition of the integer beneath the cursor on the scale of each of the two answer beams.

If larger numbers are required, more beams are added to the balance as appropriate and in each as many answer beams will be moved so that the numeral 10 will register with the cursor, leaving one answer beam at the appropriate intermediate position. The answer then will be the simple addition or multiplication of the number of answer beams in which the unit 10 registers with the cursor, together with the addition of the unit registering with the cursor of the last answer scale.

Simple multiplication and division can also be undertaken using the linear scales. For instance if the unit 12 is to be divided by the unit 4, then it will be necessary to use two beams having the question scale with one beam being placed so that the unit 10 registers with the cursor and the second beam being placed so that the unit 2 registers with the cursor thereby giving a total of 12 units. The linear answer scales are then utilized and the beam is moved through the cradle until the unit 4 registers with the cursor. If the balance is not in equilibrium, an additional beam is added to the cradle and is moved until the unit 4 registers with the cursor. This process is repeated until the balance is in equilibrium, whereupon the number of answer scales can then be added to demonstrate the division of 12 by 4, i.e. the answer will be 3 beams. Division of a number which will leave a remainder can also be demonstrated since the balance can only be placed in equilibrium with the last scale indicating a unit which will be the remainder from the division.

By using the antilog scales, more complicated calculations of division and multiplication can be demonstrated. For instance if it is required to multiply 2 by 4 then the beam having the Q× scale is positioned so that the unit 2 will register with the cursor and the second beam is so positioned that the unit 4 of the Q× scale will register with the cursor. A beam having the answer scale is slid through the cradle until the unit is in balance, whereupon the unit 8 will register with the cursor thus demonstrating the answer to a simple multiplication. If it is desired to multiply numbers having an answer greater than 10 then four beams will be utilized, that is two question scales and two answer scales. Normally the first answer scale will be positioned so that the unit 10 will register with the cursor and the second answer scale will then be moved until the unit is in balance. In this case the numbers greater than 10 are factorised into 10's so as to demonstrate the basis of the decimal system.

The balance can also be utilized to demonstrate reciprocals, percentages and proportions and in addition to find roots, square roots, and power factors.

It will be understood that in making calculations and so demonstrating the interaction of the various units, regard must be had to whether the scale indicates a plus or a minus denomination so that a large variety of calculation can be demonstrated and made. The above examples are merely indicative of some of the methods that can be utilized with the device.

I claim:

1. A calculating device comprising a rockable cradle adapted to be rocked about an axis of rotation and to support a plurality of beams, each of which has longitudinal sliding movement within said cradle in a direction parallel to the other said beams, and transverse to the said axis of rotation; the said cradle having a cursor line which extends parallel to the said axis of rotation; wherein at least two of the beams are slidable separately within the cradle to provide a rotating torque about the axis of rotation of the said cradle, said rotating torque being dependent upon the combined out-of-balance weight of the beams in relation to the said cursor line, and wherein at least one further beam is longitudinally slidable within the cradle to a position where it may impart a further rotating torque about the axis of rotation of the said cradle, said further rotating torque being antiphase to the combined rotating torque of the said two beams.

2. The calculating device as claimed in claim 1 wherein each beam of said plurality of beams is provided on at least one of its faces with a calculating scale comprising a plurality of integers spaced apart a predetermined distance.

3. The calculating device as claimed in claim 1 wherein the said two of the beams each have a face which displays a calculating question scale, comprising a plurality of integers spaced apart a predetermined distance, and wherein the said further beam has a face which displays a calculating answer scale comprising a plurality of integers spaced apart a predetermined distance.

4. The calculating device as claimed in claim 3 wherein each said calculating scale is provided with a zero point, the said zero point being coincidental with the centre of balance of the beam.

5. The calculating device as claimed in claim 1, 2, or 3 wherein the said cradle is adapted to be joined to the cradle of at least one further calculating device.

6. A method for using a calculating device comprising a rockable cradle adapted to be rocked about an axis of rotation and to support a plurality of beams, each of which has longitudinal sliding movement within said cradle in a direction parallel to the other said beams, and transverse to the said axis of rotation; the said cradle having a cursor line which extends parallel to the said axis of rotation; wherein at least two of the beams are slidable separately within the cradle to provide a rotating torque about the axis of rotation of the said cradle, said rotating torque being dependent upon the combined out-of-balance weight of the beams in relation to the said cursor and wherein at least one further beam is longitudinally slidable within the cradle to a position where it may impart a further rotating torque about the axis of rotation of the said cradle, said further rotating torque being antiphase to the combined rotating torque of the said two of the beams, and wherein the said two of the beams each have a face which displays a calculating question scale comprising a plurality of integers spaced apart a predetermined distance, and wherein the said further beam has a face which displays a calculating answer scale comprising a plurality of integers spaced apart a predetermined distance, said method comprising sliding a first beam of the said two of the beams so that a question integer on the question scale of the said beam registers with the said cursor line, sliding the second of the said two of the beams so that a further question integer on the question scale of the said beam registers with the said cursor line, sliding the said further beam until the said rotating torque about the axis of rotation of the said cradle provided by the said further beam is equal to but antiphase to the said rotating torque about the axis of rotation of the said cradle provided by the said first and second of the said two of the beams, and reading the integer registering with the said cursor line on the answer scale.

* * * * *